United States Patent [19]

Powers

[11] Patent Number: 4,535,823

[45] Date of Patent: Aug. 20, 1985

[54] METHOD OF FILLING CONTAINERS WITH A VISCOUS SUBSTANCE

[75] Inventor: Richard Powers, Wayne, Pa.

[73] Assignee: Accupac, Inc., Mainland, Pa.

[21] Appl. No.: 521,105

[22] Filed: Aug. 17, 1983

[51] Int. Cl.[3] ..... B65B 3/04

[52] U.S. Cl. ..... 141/5; 141/27; 141/374

[58] Field of Search ..... 141/1-12, 141/374, 18-27, 250-284, 285-310, 311 R, 392

[56] References Cited

FOREIGN PATENT DOCUMENTS 616623 2/1961 Italy ..... 141/374

*Primary Examiner*—Houston S. Bell, Jr.

*Attorney, Agent, or Firm*—Howson and Howson

[57] ABSTRACT

A container having an actuating mechanism with a depending flexible central stem is filled with a flowable viscous substance by the method disclosed. In the method, the container is disposed with its open end facing upwardly for receiving the lower end of a filling tube having a camming surface which engages the stem and displaces it laterally as the filling tube enters the container and advances alongside the stem. After the filling tube reaches a predetermined depth, discharge of the viscous material begins and continues as the filling tube is withdrawn from the container.

9 Claims, 8 Drawing Figures

METHOD OF FILLING CONTAINERS WITH A VISCOUS SUBSTANCE

FIELD OF THE INVENTION

The present invention relates to container filling methods, and more particularly, the present invention relates to a method for rapidly filling a slender container with a flowable viscous substance.

BACKGROUND OF THE INVENTION

Recently, a novel dispenser for permitting measured quantities of toothpaste to be applied onto a toothbrush has been designed. The dispenser comprises an elongated tubular container mounting at its upper end a finger-operated actuating mechanism and spout. A flexible elongated stem depends centrally inside the container from the actuating mechanism and is connected at its lower end to a follower which closes the lower end of the container and which ratchets upwardly along the stem in response to operation of the actuating mechanism. The follower pushes the toothpaste upwardly in the container and out the spout each time the actuating mechanism is pressed. A screw-on cap is provided to cover the actuating mechanism and spout.

Certain problems have been encountered in filling the above-described dispenser with toothpaste in a high speed manner. The problems are caused by the slenderness of the container, the presence therewithin of the central stem, the viscosity of the toothpaste, and the tendency for it to form air bubbles or pockets in the container during filling. Air pockets are undesirable because they affect adversely the speed with which the container can be filled as well as the quality of filling.

OBJECTS OF THE INVENTION

With the foregoing in mind, a primary object of the present invention is to provide a novel method for filling an elongated container with a viscous material.

It is another object of the present invention to provide an improved method for filling with toothpaste a slender container having a flexible central stem which forms part of the dispensing mechanism.

Yet another object of the present invention is to provide a unique method for filling a slender container with toothpaste in a high speed manner which avoids the formation of air pockets in the container.

SUMMARY OF THE INVENTION

More specifically, the present invention provides a method of filling with a flowable viscous material a dispenser comprising a container and an actuating mechanism having a stem which depends centrally in the container and terminates adjacent its lower end. The method includes the steps of disposing the open end of the container upwardly, advancing toward the open end of the container the lower end of a filling tube having a camming surface thereon, and engaging the camming surface against the stem for displacing the stem laterally toward a side of the container. After initial engagement, the filling tube continues to advance lengthwise in the container alongside the stem until it reaches a predetermined depth. At that depth, the viscous substance is discharged into the container laterally of the stem, and this purges the container of air. The discharge continues as the filling tube is withdrawn from the container. A follower is subsequently engaged with the stem to close the bottom of the container. The method is particularly suited for filling the container with toothpaste.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED METHOD

Figures 1, 2, 3, 4, 5, 6, 7, 8:
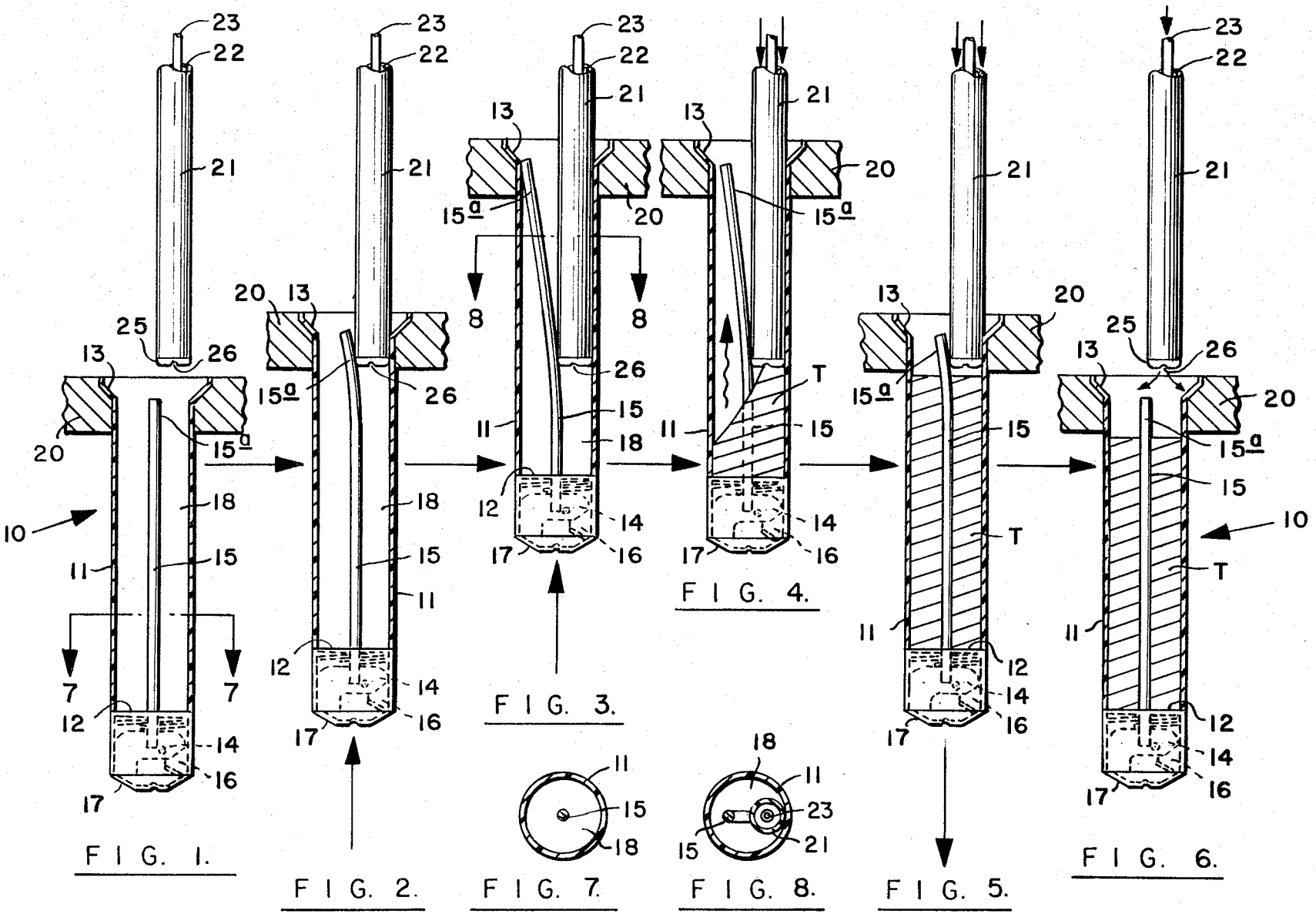
FIGS. 1–6 are schematic views illustrating the sequence of steps involved in practicing the method of the present invention.
FIG. 7 is a transverse sectional view taken on line 7—7 of FIG. 1.
FIG. 8 is a transverse sectional view taken on line 8—8 of FIG. 3.

Referring now to the drawings, FIGS. 1–6 illustrate schematically the sequence of steps involved in filling a dispenser with a viscous flowable material, such as toothpaste utilizing the method of the present invention. As best seen in FIG. 1, the dispenser 10 comprises an elongated tubular wall 11 defining a container having a partition 12 extending across its upper end (lower end as illustrated) and a flaired base 13 defining an open lower end which, when filled, is closed by a follower, not shown. An actuating mechanism 14 is mounted adjacent to the partition 12. The actuating mechanism 14 includes an elongated flexible central stem member 15 which extends lengthwise of the container wall 11 and terminates adjacent to its open lower end 13. The stem 15 engages spring teeth surrounding a central bore on the follower, and the stem functions, when the actuating mechanism 14 is operated, to ratchet the follower lengthwise inside the container wall 11 for applying pressure to the toothpaste and causing measured amounts of the toothpaste to be dispensed from the spout 16 after the protective cap 17 has been removed.

As best seen in FIG. 7, the container wall 11 has a circular cross-section, and the stem 15 extends along the central longitudinal axis of the container wall 11. The annular chamber 18, formed between the stem 15 and the container wall 11, is filled with toothpaste before the follower is engaged with the lower end of the stem 15 to complete the filling procedure. By way of example, the method of the present invention has been found to be particularly effective in filliing containers such as described having a length of about 5 inches and a diameter of about $1\frac{1}{4}$ inches, defining a slenderness ratio, i.e. length divided by diameter, of about 4:1.

As noted heretofore, one of the major problems associated with filing the dispenser 10 with toothpaste has been the formation of air pockets in the container wall 11 adjacent the actuating mechanism 14. Heretofore, satisfactory filling has been achieved only by slowing down the rate of fill. This has the obvious disadvantage of reducing production rates with a concomitant increase in production costs.

In accordance with the present invention, an improved method has been developed for filling the dispenser 10 with toothpaste in an efficient manner at relatively high flow rates without forming air pockets. While the method will be described in connection with filling the dispenser 10 with a dentifrice, such as toothpaste and denture cleaner, it should be apparent that the method may be utilized effectively with any flowable viscous material, such as cosmetic creams, shaving gels and foam, hand creams and lotions, liquid soap, caulking, grease, and the like. Thus, the method of the present invention should not be regarded as being limited to the filling containers with toothpaste.

Referring now to FIG. 1, the first step in the method involves the placement of the dispenser 10 in a fixture 20 with the open end 13 of the container wall 11 facing upwardly. Preferably, the fixture 20 is a rotary table which advances sequentially among a series of stations, including loading, unloading, etc. The sequence of steps illustrated in FIGS. 1–6 all occur at the filling station located at one position adjacent to the periphery of the rotary table.

At the filling station, an elongated vertically disposed filling tube 21 is mounted above the table 20. The filling tube 21 includes a tubular passage 22 connected to a source of toothpaste under pressure (not shown) and an air pipe 23 which depends centrally downward in the filling tube 21 for purposes to be described. The filling tube 21 is formed at its lower end with a tapered, preferably curved, camming surface 25 which surrounds a discharge port 26 through which the toothpaste is ejected. At the filling station, means is provided for moving the dispenser 10 axially with respect to the filling tube 21. In the illustrated method, such motion is provided by raising the dispenser 10 upwardly.

In the method of the invention, the container wall 11 is disposed with its open end 13 facing upwardly toward the filling tube 21, such as illustrated in FIG. 1. The container wall 11 is arranged with respect to the filling tube 21 in such a manner that the longitudinal axis of the filling tube 21 is offset laterally with respect to the longitudinal axis of the container 11 so that the discharge port 26 of the filling tube 21 is not aligned with the central stem 15. The radius of the filling tube 21 is greater than the distance between the central axis of the container wall 11 and the central axis of the filling tube 21. Thus, there exists a certain amount of interference between the filling tube 21 and the stem 15.

Referring now to FIG. 2, the next step in the method involves advancing the container wall 11 upwardly with respect to the filling tube 21. Such motion causes the camming surface 25 on the lower end of the filling tube 21 to engage laterally the free end **15*a* of the stem 15, thereby causing it to move toward a side of the container wall 11 away from the central longitudinal axis thereof. This motion is insured by virtue of the cam surface 25 and the aforementioned dimensional relationship between the filling tube 21 and the stem 15**.

In order to accomodate those rare occasions when the free end **15*a* of the stem 15 may be off center and thereby directly in the path of the filling tube 21, a pair of air nozzles (not shown) are mounted to the tube 21 adjacent its lower end and operate automatically to deflect the stem and 15*a* laterally prior to engagement of the cam surface 25 with the stem 15**.

The method continues with the container wall 11 being displaced further upwardly as illustrated in FIG. 3. This causes the filling tube 21 to be inserted more deeply into the chamber 18 and the stem 15 to be displaced further leftward toward the inside of the container wall 11. See FIG. 8. As illustrated in FIG. 3, upward motion of the container wall 11 is stopped automatically when the discharge port 26 of the filling tube 21 has been inserted to a depth of about two-thirds the length of the container wall 11.

When the filling tube 21 reaches the aforementioned predetermined depth within the chamber 18, a valve mechanism (not shown) is automatically actuated to cause toothpaste T to be discharged under pressure into the chamber 18. The toothpaste T flows downwardly against the partition 12 and then laterally around the stem 15 before it begins to rise in the chamber 18. As the upper surface of the toothpaste T rises, it forces air out of the chamber 18 in the direction indicated by the arrow in FIG. 4. The air flows upwardly along the inside of the container wall 11, the stem 15 and the filling tube 21 and thence to the atmosphere through the open upper end 13 of the container wall 11.

After the discharge of toothpaste T has been initiated in the manner described and illustrated in FIG. 4, the container wall 11 is displaced downwardly in the manner illustrated in FIG. 5 for causing the filling tube 21 to be withdrawn from the chamber 18. During the course of movement of the container wall 11 downwardly with respect to the filling tube 21, toothpaste T continues to flow from the discharge port 26 until it has filled the chamber 18 to a predetermined level such as the level illustrated in FIG. 5. During the withdrawal of the filling tube 21, the stem 15 tends to resume its axially centered position inside the container wall 11; however, the stem 15 is preferably centered in a separate operation prior to insertion of the follower into the bottom of the chamber 18.

After the chamber 18 has been filled to the depth indicated, air under pressure is supplied to the discharge port 26 through the pipe 23 for the purpose of blowing off any excess toothpaste which may remain around the discharge port 26. Air flow is automatically controlled by another valve (not shown). The air flow is indicated by the arrow in FIG. 6.

Thereafter, the filled dispenser 10 is advanced to another station where the follower (not shown) is inserted in the open end 13 of the container wall 11 and is pressed downwardly to engage the lower end **15*a* of the stem 15. The container 10 is subsequently ejected from the table 20** for packaging in a suitable carton.

The method of the present invention has been found capable of filling slender dispensers, such as the dispenser 10, with toothpaste at a flow rate of about 120 grams per second without forming air pockets in the container chamber 18, the toothpaste having a viscosity of about 300,000 centipoises at 29° C. The method is capable of filling 50 tubes per minute while avoiding the air entrapment problem noted heretofore.

In view of the foregoing, it should be apparent that an improved method has been provided for filling slender containers with viscous materials, such as toothpaste, in a rapid manner without forming undesirable air bubbles or pockets within the filled container.

While a preferred method has been described in detail, various modifications, alterations and changes may be made without departing from the spirit and scope of the present invention as defined in the appended claims.

I claim:

1. A method of rapidly flowing a viscous substance into a container having at one end an actuating mechanism and a depending flexible central stem terminating adjacent an open opposite end of the container without forming substantial air pockets at said one end, said method comprising the steps of:

disposing the container with its open end facing upwardly, advancing relative to the open end of the container the lower end of a filling tube, engaging the filling tube laterally against the stem and displacing it toward a side of the container, inserting the filling tube lengthwise in the container to a predetermined location, at said location initiating the discharge of the viscous substance into the container laterally of the stem for displaciing air laterally and axially out of the container, and withdrawing the filling tube from the container while simultaneously discharging the viscous substance therefrom and thereby continuing to discharge air axially out the open end of the container, whereby the container can be filled rapidly without forming substantial air pockets adjacent to its one end.

2. The method according to claim 1 wherein the filling tube has a camming surface on its lower end, and wherein said engaging step includes the step of contacting said camming surface with said stem adjacent said open end of the container and continuing the contact between said filling tube and said stem during said inserting step to effect said lateral displacement of said central stem.

3. The method according to claim 2 wherein said filling tube has an outside radius greater than the spacing between the central longitudinal axis of the filling tube and the container wall for maintaining said lateral displacement of said stem during filling.

4. The method according to claim 3 wherein the container has a slenderness ratio of about 4:1.

5. The method according to claim 1 wherein said viscous material has a viscosity of about 300,000 centipoises at 29° C.

6. The method according to claim 5 wherein said viscous material is toothpaste.

7. The method according to claim 1 wherein said viscous material is toothpaste.

8. The method according to claim 1 wherein said advancing and inserting steps are effected by displacing the container upwardly relative to the filling tube and said withdrawing step is effected by displacing the container downwardly relative to the filling tube.

9. The method according to claim 1 wherein said viscous material is flowed at a rate of about 120 grams per minute into a container havng a slenderness ratio of about 4:1.

* * * * *